United States Patent [19]

Johnson, Jr. et al.

[11] 4,039,238

[45] Aug. 2, 1977

[54] LOUVERED CONNECTORS AND CONTACT ELEMENTS THEREOF

[75] Inventors: Glenn W. Johnson, Jr., Summit; Paul F. Lindlau, East Orange, both of N.J.

[73] Assignee: Amerace Corporation, New York, N.Y.

[21] Appl. No.: 683,527

[22] Filed: May 5, 1976

Related U.S. Application Data

[63] Continuation of Ser. No. 503,783, Sept. 6, 1974, abandoned.

[51] Int. Cl.[2] ..... H01R 13/12; H01R 13/20

[52] U.S. Cl. ..... 339/95 R; 113/119; 339/256 RT

[58] Field of Search ..... 339/95 R, 95 A, 95 D, 339/256, 258, 252–254, 262, 74 R; 113/119

[56] References Cited

U.S. PATENT DOCUMENTS

| | | | |
|---|---|---|---|
| 3,453,587 | 7/1969 | Neidecker | 339/256 RT |
| 3,861,595 | 1/1975 | Deal | 339/95 R |
| 3,861,776 | 1/1975 | Deal | 339/74 R |

FOREIGN PATENT DOCUMENTS

| | | | |
|---|---|---|---|
| 525,754 | 9/1940 | United Kingdom | 339/262 RR |

*Primary Examiner*—Roy Lake
*Assistant Examiner*—Neil Abrams
*Attorney, Agent, or Firm*—S. Michael Bender

[57] ABSTRACT

Connectors having strip member contact elements wherein louvers or contact fingers extend in dissimilar extents from opposed sides of the strip member. Method is also disclosed for enhancing contact surface area between the extremities of contact fingers and complementary contact surfaces.

53 Claims, 10 Drawing Figures

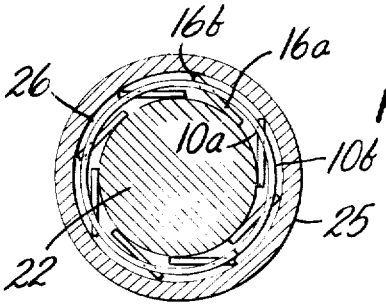
FIG. 4(b)
FIG. 5
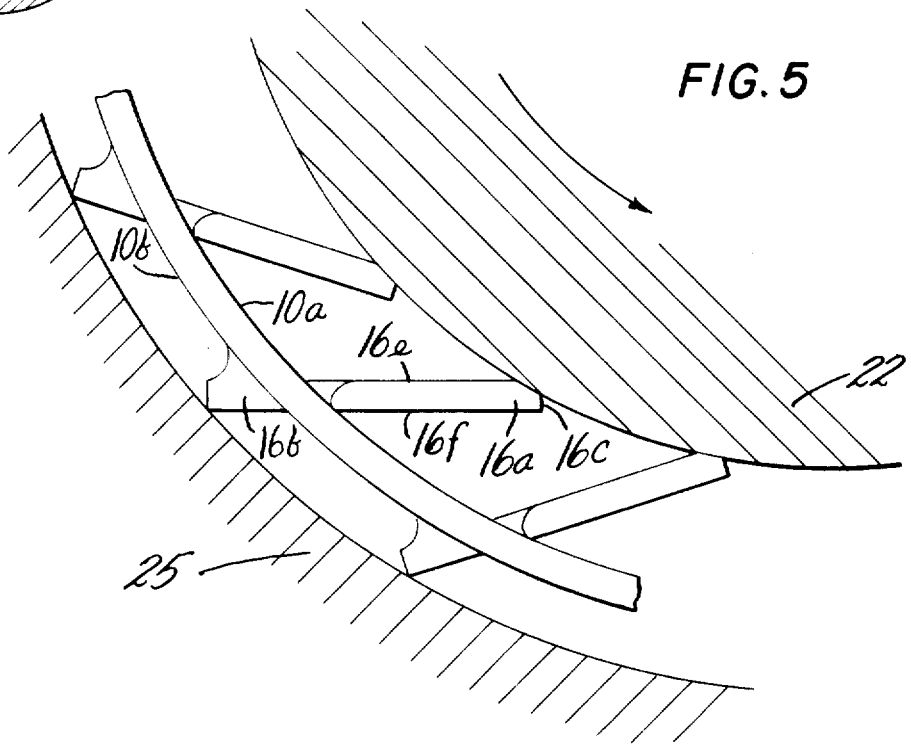
FIG. 6(a)
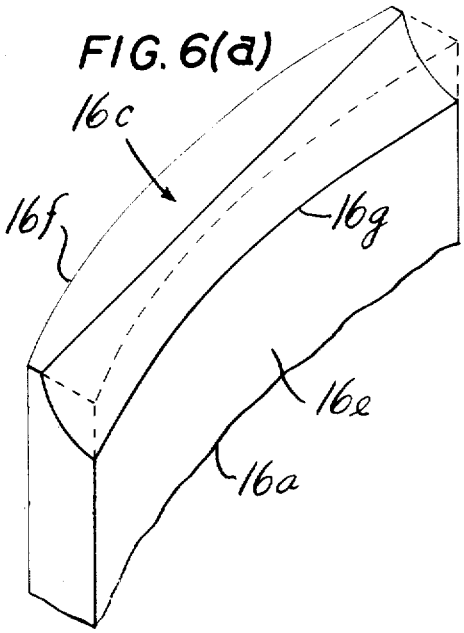
FIG. 6(b)
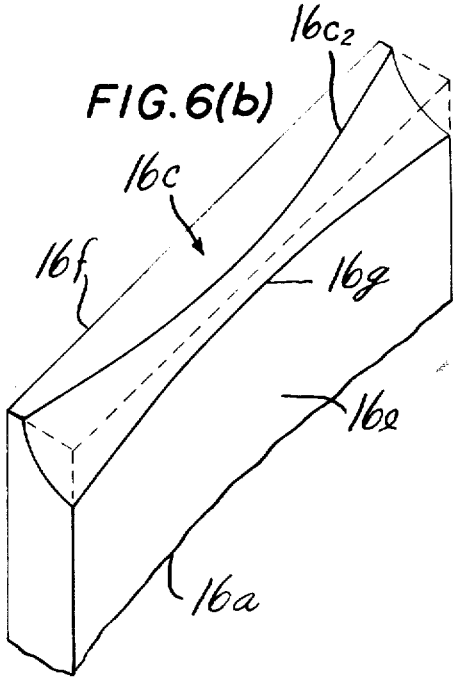

LOUVERED CONNECTORS AND CONTACT ELEMENTS THEREOF

This is a continuation of application Ser. No. 503,783, filed Sept. 6, 1974, now abandoned.

FIELD OF THE INVENTION

This invention relates generally to electrical connectors and contacts thereof and more particularly to electrical contacts of the type having resilient contact fingers for resiliently engaging a complementary contact surface.

BACKGROUND OF THE INVENTION

Known connectors with contacts having contact fingers in resilient engagement with a complementary contact surface, so-called "louvered connectors", such as are illustrated in Neidecker U.S. Pat. No. 3,453,587 and Crabbs U.S. Pat. No. 2,217,473, typically comprise elongate conductive strip members having a plurality of longitudinally spaced transverse openings defining longitudinally and transversely extending expanses therebetween which are bent or twisted with respect to the strip member so as to define contact fingers having opposed extremities displaced from respective opposite surfaces of the strip member. It is common to deploy these contacts by having the strip member ends disposed in a juxtaposed manner so as to provide a contact element having a substantially circular interior into which a male contact in the form of a pin member is insertable. The pin member diameter being greater than the diameter of the locus of the radially interior extremities of the contact fingers, the contact fingers are resiliently flexed upon pin member insertion and resiliently engage the same under sufficient contact pressure to provide electrical contact therewith. The strip member finger extremities extending radially exteriorly of the strip member engage the walls of a socket seating the contact element whereby an electrical path capable of transferring currents of relatively high magnitudes is provided between the pin member and the socket.

Performance considerations of presently known connectors and contacts of this type are several in number. Secure engagement of course need be provided between the separable connector parts, i.e., the pin member and the radially interiorly extending contact finger parts. This consideration necessitates careful control of manufacturing tolerances as between pin member diameter and contact element interior diameter, directly affecting manufacturing costs. Secondly, the resistance of the electrical connector to current flow therethrough is dependent to a large degree on surface contact area as between the contact fingers and both the pin member and the socket, engagement of the radially interior contact finger extremities and pin member being most significant since they are repeatedly separable in connector use. Reliability of this type of connector is also dependent on the cooperation of the contact element and the socket such that the former is not readily removable from the latter, giving rise to manufacturing tolerance control respecting the socket recess provided for containment of the contact element.

Known connectors of this type are not considered to readily exhibit the foregoing performance characteristics to the degree desired. Thus, unduly close manufacturing tolerances are demanded by existing connector structures of this type. Surface area engagement of the separable surfaces is regarded as less than adequate for cerain applications in which particularly low connector electrical resistance is desired. Finally, in the absence of structure, additional to the electrically functioning parts of the contact element and socket themselves, for securely seating the contact element in the socket, the contact element has been observed to be separable from the socket upon manipulation of the pin member.

SUMMARY OF THE INVENTION

It is an object of the present invention to provide improved connectors of the subject type, exhibiting improvements over presently-known louvered connectors in each of the performance considerations discussed above.

In attaining the foregoing and other objects, the present invention provides, in its particularly preferred embodiment, louvered connector structure wherein contact fingers extend outwardly from an elongate strip member in opposed parts having respectively dissimilar longitudinal extents, thereby providing lessened spring rate for the contact finger part engaging the pin member and serving to reduce manufacturing tolerances on the parts of the connector. Such arrangement also provides for a deeper seating of the contact element in the socket recess and improves contact element retention. The invention further contemplates contact finger edge geometry serving to improve electrical engagement between the separable parts of such connectors by increasing the contact area afforded by the contact fingers.

The foregoing and other objects and features of the invention will be evident from the following detailed description of preferred embodiments thereof as illustrated in the drawings wherein like reference numerals identify like parts throughout.

BRIEF DESCRIPTION OF THE DRAWINGS

FIG. 4(b) is a sectional view of an alternative embodiment of a connector in accordance with the invention.

FIG. 5 is an enlarged partial sectional view of a further alternative embodiment of a connector in accordance with the invention showing radially inward contact finger parts in engagement with a complementary contact surface.

FIG. 6(a) illustrates the configuration of the FIG. 5 contact finger parts when resiliently flexed and FIG. 6(b) illustrates such configuration under non-flexed condition.

DESCRIPTION OF THE PREFERRED EMBODIMENTS

Figure 1:
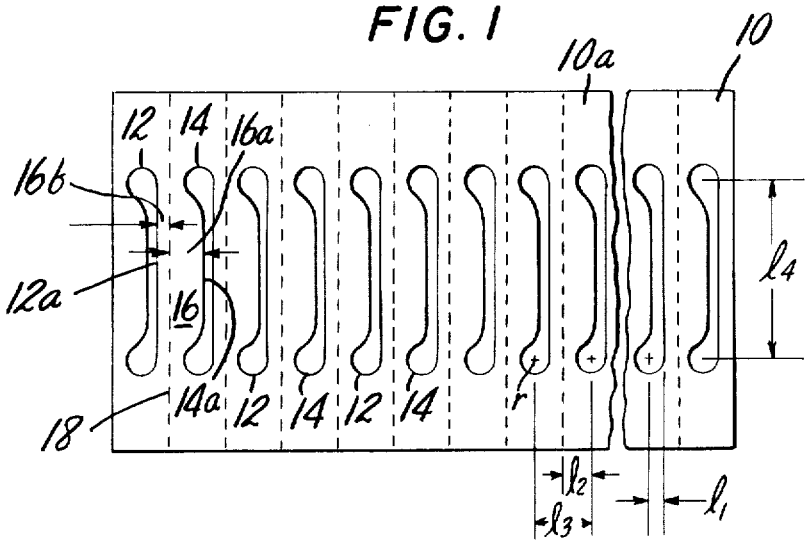
FIG. 1 is a plan view of an apertured strip member before expanses between adjacent openings therein are displaced outwardly of the openings to define contact fingers.
Figure 2:
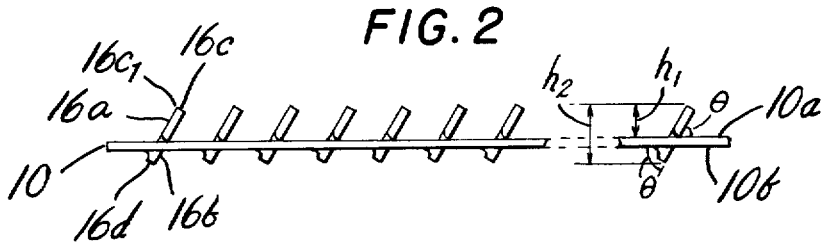
FIG. 2 is a side elevational view of the strip member of FIG. 1 after expanses between adjacent openings therein are displaced outwardly of the openings to define contact fingers.

Referring to FIGS. 1 and 2, elongate strip member 10 is comprised of electrically conductive material and includes a series of longitudinally spaced transverse openings 12, 14 extending through opposed first and second surfaces 10*a* and 10*b*. Considering the leftwardmost pair of openings, the strip member defines a continuous longitudinally and transversely extending expanse 16 therebetween, bordered by respectively adjacent transverse edges or boundaries 12*a* and 14*a* of these openings. Expanse 16 is disposed or displaced angularly outwardly of these openings, such as by twisting, about a transverse axis, e.g., axis 18, which axis is located longitudinally closer to one of such edges than it is to the other thereof. In the case of axis 18, which is longitudinally closer to edge 12*a* than to edge 14*a*, a first part 16*a* of expanse 16 is disposed, as shown in FIG. 2, at an acute angle $\theta$ relative to strip member surface 10*a* and a second parts 16*b* of expanse 16 is disposed at an acute angle $\theta$ relative to strip member surface 10*b*, with first part 16*a* being of greater longitudinal extent than second part 16*b*. Upon such twisting of expanse 16, the same defines a contact finger or louver.

Figure 3:
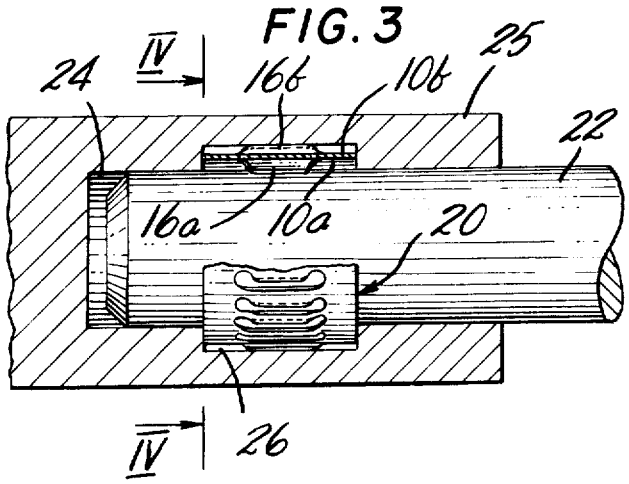
FIG. 3 is a side elevational view, partly in section and partly broken away to show detail, of a connector employing the strip member of FIG. 2 as a contact between a pin member and a socket.
Figure 4A:
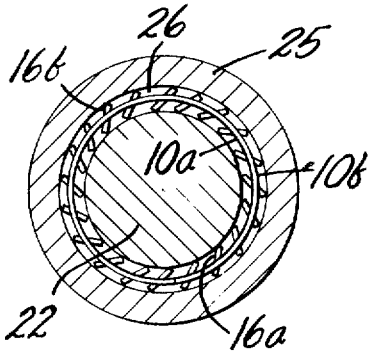
FIG. 4(a) is a sectional view as seen from the plane IV—IV of FIG. 3.

So prepared, the strip member then is formed into a cylindrical or ring-like shape with contact finger parts 16*a* extending radially inward of such cylinder and contact finger parts 16*b* extending radially outward of the cylinder, as shown in FIGS. 3 and 4(a). This arrangement provides a female contact element 20 which, when seated in socket 24 of housing 25, as depicted in FIG. 3, resiliently engages the encircling housing wall through extremities 16*d* of finger parts 16*b*, and is adapted for receiving a male contact element in the form of a cylindrically-shaped pin member 22, which latter will be resiliently engaged by sharp contact edges $16c_1$ of each of extremities 16*c* of finger parts 16*a*. A recess 26 is provided in socket 24 for seating contact element 20 and retaining it against withdrawal. The housing socket diameter is slightly greater than the pin member outer diameter, with the latter greater than the locus of extremities 16*c* of the contact fingers when the pin member is not receivably engaged within the female contact element 20 in housing socket 24. The contact fingers accordingly provide electrical connection between the pin member and the housing when the pin member is received within the housing socket substantially as shown in FIGS. 3 and 4(a).

Various advantages attend the asymmetrical longitudinal relation existing among the twist axis and the respectively adjacent edges of successive strip member openings. In one aspect, the radially interior contact finger parts 16*a* encompass a major extent of the combined parts 16*a* and 16*b* of the contact fingers. Parts 16*a* thus constitute radially interior spring elements of greater longitudinal extent than those of the above-referenced known louvered connectors, which are derived from twisting of the strip member expanse about a transverse axis symmetrically disposed relative to respectively adjacent transverse edges of successive strip member openings. Since spring rate, i.e., the ratio of load to spring deflection, is inversely proportionl to spring longitudinal extent, this geometry of the invention provides for lower spring rate for the interior contact finger parts than in known louvered connectors (the spring material, its thickness and its width being the same). As a result, it has been found that resilient engagement of contact fingers of connectors constructed in accordance with the invention providing desired electrical contact occurs for pin member varying over a greater range in diameter than is the case for otherwise like prior louvered connectors. Manufacturing tolerances as between the locus of the extremities of interior contact finger parts and pin diameter is thereby relaxed, giving rise to lowered costs in manufacture.

Apart from this advantage attending increased longitudinal extent of radially interior contact finger parts, further advantage attends the consequent reduction in length of radially exterior contact finger parts. With part 16*b* having longitudinal extent reduced as compared to like elements in the symmetrical twist axis case of known louvered connectors, the radial depth of the housing recess seating the strip member may be lessened, giving rise to reduced manufacturing cost. Alternatively, for the same radial recess depth as in known louvered connectors, strip members of the invention are seated more deeply therein and hence are less susceptible to removal on manipulation of the pin member.

The asymmetry in contact finger parts may be attained and the foregoing advantages realized without need for displacing the entirety of expanse 16 outwardly of the strip member openings. Thus, contact finger parts 16*a* and 16*b* may comprise opposed end portions of such strip member expanse displaced outwardly of the strip member openings, with one such end portion being of greater longitudinal extent than the other. The strip member is then formed into cylindrical shape as discussed above, such that the radially interior end portions are of greater longitudinal extent than the radially exterior end portions. In the particularly preferred embodiment, however, the sum of the longitudinal extents of the respective opposed end portions of each contact finger equals the longitudinal extent of the strip member continuous expanse defining such contact finger.

Referring now to the connector embodiment of FIG. 4(b), the contact fingers are formed by asymmetrical twisting but are disposed at an angle less than angle $\theta$ of FIG. 2, whereby contact finger parts 16*a* are in other than sharp contact edge engagement with pin member 22. That is, in the embodiment of FIG. 4(b), contact is achieved by resilient engagement between elongate flat surface 16*e* of each contact finger and the surface of the cylindrical pin member. Such FIG. 4(b) arrangement provides surface area contact between parts 16*a* and pin member 22 increased over that obtaining in endwise engagement, such as the sharp contact edge engagement described in FIG. 4(a) above. In accordance with another aspect of the invention, the contact finger extremities may be prepared as now discussed in connection with FIGS. 5, 6(a) and 6(b).

As shown in FIGS. 5 and 6(b), each contact finger part 16*a* includes opposed elongate flat surfaces 16*e*, 16*f* extending to the extremity 16*c* thereof displaced from strip member surface 10*a*. At extremity 16*c*, a curved surface portion 16*g* extends from at least one of surfaces 16*e* and 16*f*, for example, it extends from surface 16*e* as shown, toward the other surface 16*f*. At extremity 16*c*, a flat end surface is provided in a plane other than, and preferably in a plane orthogonal to, the planes of elongate flat surfaces 16*e* and 16*f*. Curved surface 16*g* intersects such extremity flat end surface over substantially the entire transverse extent of the extremity thereof, the intersection between curved surface 16*g* and the flat end surface defining a curved common boundary $16c_2$ for such flat end surface and curved surface 16*g*. It will be noted that the curvature of such common boundary $16c_2$ occurs entirely within the plane defined by the flat end surface of extremity 16c.

Such curved surface 16g may be located other than at extremity 16c, e.g., in the case where contact is to be made as in FIG. 4(b) the surface 16g may be included as a portion of the elongate flat surface 16e at a position displaced from the flat end surface of extremity 16c.

In forming surface 16g, material is removed from extremity 16c, when the finger is in its flexed condition as shown in FIG. 6(a), until the curved surface 16g is defined. The broken line outline in FIG 6(a) indicates the original configuration of the finger prior to the removal of such material when the finger is in the flexed condition, whereas the broken line outline in FIG. 6(b) indicates the original configuration of the finger prior to the removal of such material and when the finger is in its unflexed condition.

Preferably, this material removal is effected by forming the strip member into contact element 20 as in FIGS. 1–4, seating the same in housing 25 and inserting a hone in the shape and size (particularly outer diameter) of pin member 22 into the contact element interior, thus causing the contact finger parts to flex into resilient engagement with the hone outer surface. Under such loading each contact finger part assumes the configuration shown in FIG. 6(a), i.e., slightly bowed or curved. The hone is then rotated to remove material confined in the volume of the broken lines. The results of such practice are shown in FIG. 6(a) which depicts the curved surface contour following such rotation of the hone and prior to removal of the same from the housing. As contact finger parts 16a return to their unflexed condition upon removal of the hone, they assume the configuration shown in FIG. 6(b). Upon subsequent insertion of a pin member into the housing, increased contact surface are exists between the cylindrical outer surface of the pin member and the complementary curved surface 16g of the honed contact finger parts 16a, as shown in FIG. 5.

By way of example of a preferred method of fabricating a connector having honed louvers, a strip member comprised of beryllium copper alloy 25 of width 0.687 in. and length 1.078 in. is stamped to provide element cutouts or openings of the type shown in FIG. 1, the dimensions in FIGS. 1 and 2 being: $r = 0.031$ in.; $l_1 = 0.018$ in.; $l_2 = 0.049$ in.; $l_3 = 0.098$ in.; $l_4 = 0.355$ in.; $h_1 = 0.049$ in.; $h_2 = 0.069$ in.; and $\theta = 55°$. The strip member is formed into a cylindrically shaped female contact element with the inner strip member diameter being 0.438 in. The contact element is next seated in a cylindrical holder of inner diameter 0.381 in. and a cylindrical diamond hone of outer diameter 0.310 in., grit 300, is inserted in the contact element interior and is rotated through four complete revolutions in the direction of inclination of the radially interior contact finger parts.

Figure 7:
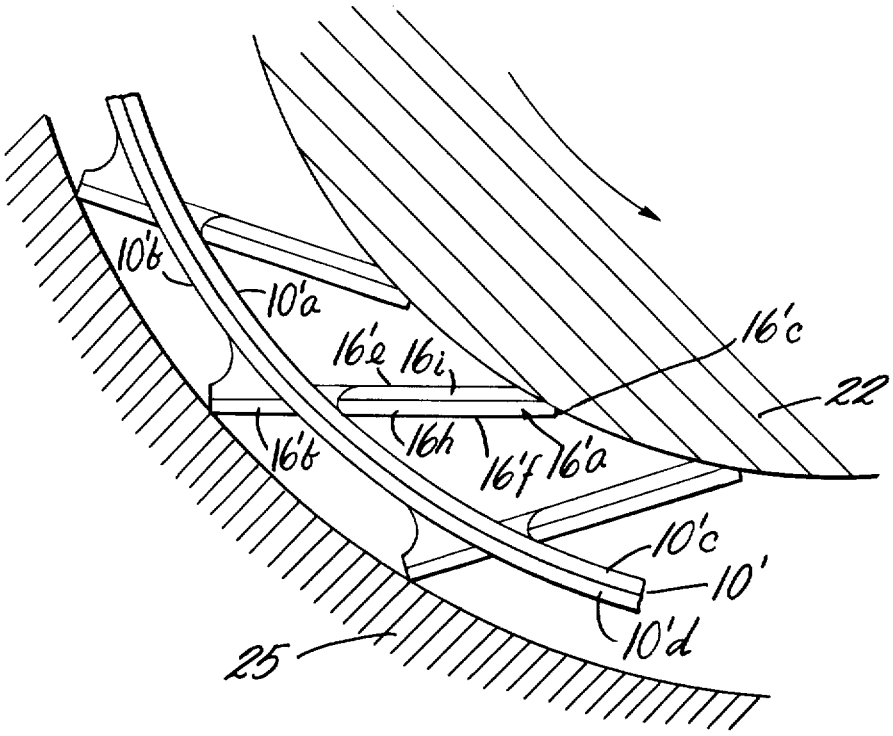
FIG. 7 is an enlarged partial elevational view of a still further embodiment of a connector in accordance with the invention.

Referring to FIG. 7, there is shown a further embodiment of the invention wherein strip member 10' is a laminated structure including layer 10'c comprised of material, e.g., copper, having relatively low electrical resistance and layer 10'd comprised of material, e.g., beryllium, having a relatively high unit resilience. Contact finger parts 16'a accordingly include a first low electrical resistance layer 16i and a second layer 16h of high resilience acting as a spring member resiliently engaging pin member 22. Where extremity 16'c is honed as above discussed, a surface is defined by portions of each layer. As will be seen in FIG. 7, such surface and layer 16i and 16'b provide a direct low resistance path from the pin member to housing 25.

Figure 8:
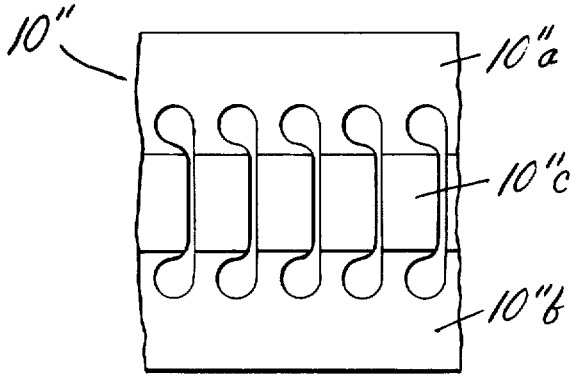
FIG. 8 is a plan view of a further embodiment of the strip member shown in FIG. 1.

In FIG. 8, strip member 10'' includes marginal portions 10''a and 10''b, each comprised of high unit resilience material as discussed above for layer 16i, and a central portion 10''c, comprised of low electrical resistance material as discussed above for layer 16h. With this configuration, radially interior contact finger parts have margins functioning as springs and an intervening expanse providing a direct low resistance path from the pin member to the housing.

In instances wherein low connector electrical resistance is of particular concern, the invention contemplates the coating of the contact fingers with a substance of low resistance, e.g., as by plating or the like.

Various changes may evidently be introduced in the foregoing embodiments without departing from the spirit or scope of the invention. By way of example, the strip member is characterized as elongate in the direction of the spacing of openings therein only for purposes of clarity. While the foregoing embodiments all treat a female contact element having an interior hollow for receiving a complementary male contact element, the invention of course contemplates the placement of contact finger parts 16a in radially exterior disposition for engagement with a complementary contact element adapted to encircle such parts. Accordingly, the foregoing separately disclosed embodiments are intended in an illustrative and not in a limiting sense. The true spirit and scope of the invention is set forth in the following claims.

What is claimed is:

1. An electrical contact comprising an elongate electrically conductive strip member having first and second longitudinally spaced transverse openings extending through opposed first and second surfaces thereof, said strip member defining a continuous longitudinally and laterally extending expanse between respectively adjacent transverse boundaries of said openings, said strip member expanse being displaced angularly outwardly of said openings about a transverse axis situated longitudinally closer to one of said adjacent boundaries than the other thereof.

2. The electrical contact claimed in claim 1 wherein such displaced strip member expanse defines an elongate contact finger in first part displaced angularly outwardly of said strip member first surface and in second part displaced angularly outwardly of said strip member second surface, said contact finger first part being of greater longitudinal extent than said contact finger second part.

3. The electrical contact claimed in claim 2 wherein said contact finger first part includes opposed elongate flat surfaces extending to the contact finger extremity displaced from said strip member first surface, a curved surface extending at said extremity from one of said contact finger first part elongate flat surfaces toward the other thereof.

4. The electrical contact claimed in claim 3 wherein said contact finger extremity displaced from said strip member first surface includes a flat end surface disposed in a plane other than the planes of said elongate flat surfaces of said contact finger first part.

5. The electrical contact claimed in claim 1 wherein said strip member includes a first layer and a second layer overlying said first layer, said second layer having lesser electrical resistance than said first layer, said first layer having a greater unit resilience than said second layer.

6. The electrical contact claimed in claim 5 wherein such displaced strip member expanse defines a contact finger in first part displaced angularly outwardly of said first strip member surface and in second part displaced angularly outwardly of said second strip member surface, said contact finger first part being of greater longitudinal extent than said contact finger second part.

7. The electrical contact claimed in claim 6 wherein said contact finger first part includes opposed elongate flat surfaces extending to the contact finger extremity displaced from said strip member first surface, a curved surface extending at said extremity from one of said contact finger first part elongate flat surfaces toward the other thereof, said curved surface including portions of both of said first and second layers.

8. The electrical contact claimed in claim 7 wherein said contact finger extremity displaced from said strip member first surface includes a flat end suface disposed in a plane other than the planes of said elongate flat surfaces of said contact finger first part.

9. In combination: a housing having an open end and a cylindrical socket extending axially interiorly therefrom, and a cylindrical recess in said socket of diameter greater than that of said socket; and an elongate electrically conductive strip member seated in said housing recess and having a plurality of longitudinally spaced transverse openings extending through opposed first and second surfaces thereof, said strip member defining continuous longitudinally and laterally extending expanses each between a pair of respectively adjacent transverse boundaries of successive such openings, each such strip member expanse being displaced angularly outwardly of said openings about a transverse axis situated longitudinally closer to one of said transverse boundaries of such boundary pair than the other thereof and thus defining a contact finger having a first extremity engaging a part of said housing encircling said recess and a second extremity extending interiorly into said socket.

10. The invention claimed in claim 9 further including a male contact insertable in said housing open end and comprising a pin member of diameter less than the diameter of said socket and greater than the diameter of the locus of said contact finger second extremities, said contact fingers resiliently engaging said pin member upon insertion of said male contact in said housing open end, said strip member thereby providing electrical connection between said housing and said male contact.

11. The invention claimed in claim 10 wherein each said contact finger includes opposed elongate flat surfaces extending to said contact finger second extremity, a curved surface extending at said second extremity from one of said contact finger elongate flat surfaces toward the other thereof.

12. The invention claimed in claim 11 wherein said contact finger second extremity includes a flat end surface disposed in a plane other than the planes of said elongate flat surfaces of said contact finger.

13. The invention claimed in claim 9 wherein said strip member includes a first layer and a second layer overlying said first layer, said second layer having lesser electrical resistance than said first layer, said first layer, having a greater unit resilience than said second layer.

14. The invention claimed in claim 13 wherein each said contact finger includes opposed elongate flat surfaces extending to said contact finger second extremity, a curved surface extending at said second extremity from one of said contact finger elongate flat surfaces toward the other thereof, said curved surface including portions of both said first and second layers.

15. The invention claimed in claim 14 wherein said contact finger second extremity includes a flat end surface disposed in a plane other than the planes of said elongate flat surfaces of said contact finger.

16. An electrical contact comprising an elongate electrically conductive strip member having first and second longitudinally spaced transverse openings extending through opposed first and second surfaces thereof, said strip member defining a continuous longitudinally and laterally extending expanse between respectively adjacent transverse boundaries of said openings, one end portion of said strip member expanse being displaced angularly outwardly of said strip member second surface and an opposed end portion of said strip member expanse being displaced angularly outwardly of said strip member first surface, said opposed end portion being of greater longitudinal extent than said one end portion.

17. The electrical contact claimed in claim 16 wherein the sum of the longitudinal extent of said one end portion and the longitudinal extent of said opposed end portion equals the longitudinal extent of said strip member continuous expanse defining such end portions.

18. The electrical contact claimed in claim 16 wherein each said opposed end portion includes opposed elongate flat surfaces extending to the extremity of said opposed end portion displaced from said strip member first surface, a curved surface extending at said extremity from one of said opposed end portion elongate flat surfaces toward the other thereof.

19. The electrical contact claimed in claim 18 wherein said extremity of said opposed end portion displaced from said strip member first surface includes a flat end surface disposed in a plane other than the planes of said elongate flat surfaces of said opposed end portion.

20. The electrical contact claimed in claim 16 wherein said strip member includes a first layer and a second layer overlying said first layer, said second layer having lesser electrical resistance than said first layer, said first layer having a greater unit resilience than said second layer.

21. The electrical contact claimed in claim 20 wherein each said opposed end portion includes opposed elongate flat surfaces extending to the extremity of said opposed end portion displaced from said strip member first surface, a curved surface extending at said extremity from one of said opposed end portion elongate flat surfaces toward the other thereof, said curved surface including portions of both said first and second layers.

22. The electrical contact claimed in claim 21 wherein said extremity of said opposed end portion includes a flat end surface disposed in a plane other than the planes of said elongate flat surfaces of said opposed end portion.

23. In combination: a housing having an open end and a cylindrical socket extending axially interiorly therefrom and a cylindrical recess in said socket of diameter greater than that of said socket; and an elongate electrically conductive strip member seated in said housing recess and having a plurality of longitudinally spaced transverse openings extending through opposed first and second surfaces thereof, said strip member defining continuous longitudinally and laterally extending expanses each between a pair of respectively adjacent transverse boundaries of successive such openings, one end portion of each said strip member expanse being displaced angularly outwardly of said strip member second surface and engaging a part of said housing encircling said recess and an opposed end portion of each said strip member expanse being displaced angularly outwardly of said strip member first surface and extending interiorly into said socket, said opposed end portion being of greater longitudinal extent than said one end portion.

24. The invention claimed in claim 23 further including a male contact insertable in said housing open end and comprising a pin member of diameter less than the diameter of said socket and greater than the diameter of the locus of the extremities of said strip member opposed end portions displaced from said first surface thereof, said strip member opposed end portions resiliently engaging said pin member upon insertion of said male contact in said housing open end, said strip member thereby providing electrical connection between said housing and said male contact.

25. The invention claimed in claim 24 wherein each said strip member opposed end portion includes opposed elongate flat surfaces extending to the extremity of said opposed end portion displaced from said strip member second surface, a curved surface extending at said extremity from one of said opposed end portion elongate flat surfaces toward the other thereof.

26. The invention claimed in claim 25 wherein said extremity of said opposed end portion includes a flat end surface disposed in a plane other than the planes of said elongate flat surfaces of said opposed end portion.

27. The invention claimed in claim 23 wherein said strip member includes a first layer and a second layer overlying said first layer, said second layer having lesser electrical resistance than said first layer, said first layer having a greater unit resilience than said second layer.

28. The invention claimed in claim 27 wherein each said strip member opposed end portion includes opposed elongate flat surfaces extending to the extremity of said opposed end portion displaced from said strip member second surface, a curved surface extending at said extremity from one of said opposed end portion elongate flat surfaces toward the other thereof.

29. The invention claimed in claim 28 wherein said extremity of said opposed end portion includes a flat end surface disposed in a plane other than the planes of said elongate flat surfaces of said opposed end portion.

30. The electrical contact claimed in claim 1 wherein said displaced strip member expanse includes longitudinally extending marginal portions comprised of a first material and a further portion disposed between said marginal portions and comprised of a second material, said second material having lesser electrical resistance than said first material, said first material having a greater unit resilience than said second material.

31. The electrical contact claimed in claim 16 wherein said displaced strip member expanse includes longitudinally extending marginal portions comprised of a first material and a further portion disposed between said marginal portions and comprised of a second material, said second material having lesser electrical resistance than said first material, said first material having a greater unit resilience than said second material.

32. An electrical contact for engaging a surface of a further contact matable therewith, said electrical contact comprising an elongate electrically conductive strip member having first and second longitudinally spaced transverse openings extending through opposed first and second surfaces thereof, said strip member including a longitudinally and laterally extending expanse between respectively adjacent transverse boundaries of said openings, said strip member expanse being displaced angularly outwardly of said strip member second surface, said contact finger first part including opposed elongate surfaces extending to the contact finger extremity displaced from said strip member first surface, said contact finger extremity including a contact surface portion contiguous to at least one of said opposed elongate surfaces, said contact finger surface portion extending along substantially the entire lateral extent of said strip member expanse, said contact finger surface portion having a first shape complementary to the shape of said surface of said further contact when said contact finger is in engagement with said further contact surface, said contact surface portion having a second shape noncomplementary to the shape of said surface of said further contact when said contact finger is disengaged from said further contact, said contact finger surface portion first shape providing area contact between said contact finger surface portion and said further contact surface during said engagement, said area contact extending substantially the entire lateral extent of said strip member expanse at the longitudinal extremity thereof.

33. The electrical contact claimed in claim 32 wherein said surface portion is disposed at said first finger part extremity and extends from said contact finger first part one elongate flat surface toward the contact finger first part other elongate flat surface.

34. The electrical contact claimed in claim 33 wherein said contact finger extremity displaced from said strip member first surface includes a flat end surface disposed in a plane other than the planes of said elongate flat surfaces of said contact finger first part.

35. The electrical contact claimed in claim 4 wherein said curved surface intersects said flat end surface.

36. The electrical contact claimed in claim 8 wherein said curved surface intersects said flat end surface.

37. The invention claimed in claim 12 wherein said curved surface intersects said flat end surface.

38. The invention claimed in claim 15 wherein said curved surface intersects said flat end surface.

39. The electrical contact claimed in claim 19 wherein said curved surface intersects said flat end surface.

40. The electrical contact claimed in claim 22 wherein said curved surface intersects said flat end surface.

41. The invention claimed in claim 26 wherein said curved surface intersects said flat end surface.

42. The invention claimed in claim 29 wherein said curved surface intersects said flat end surface.

43. The electrical contact claimed in claim 34 wherein said contact surface portion intersects said flat end surface.

44. The electrical contact claimed in claim 35 wherein the intersection of said curved surface and said flat end surface defines a common curved boundary extending along substantially the entire transverse extent of said contact finger extremity displaced from said strip member first surface.

45. The electrical contact claimed in claim 36 wherein the intersection of said curved surface and said flat end surface defines a common curved boundary extending along substantially the entire transverse extent of said contact finger extremity displaced from said strip member first surface.

46. The invention claimed in claim 37 wherein the intersection of said curved surface and said flat end surface defines a common curved boundary extending along substantially the entire transverse extent of said contact finger second extremity.

47. The invention claimed in claim 38 wherein the intersection of said curved surface and said flat end surface defines a common curved boundary extending along substantially the entire transverse extent of said contact finger second extremity.

48. The electrical contact claimed in claim 39 wherein the intersection of said curved surface and said flat end surface defines a common curved boundary extending along substantially the entire transverse extent of said contact finger extremity displaced from said strip member first surface.

49. The electrical contact claimed in claim 40 wherein the intersection of said curved surface and said flat end surface defines a common curved boundary extending along substantially the entire transverse extent of said extremity of said opposed end portion.

50. The electrical contact claimed in claim 41 wherein the intersection of said curved surface and said flat end surface defines a common curved boundary extending along substantially the entire transverse extent of said extremity of said opposed end portion.

51. The electrical contact claimed in claim 42 wherein the intersection of said curved surface and said flat end surface defines a common curved boundary extending along substantially the entire transverse extent of said extremity of said opposed end portion.

52. The electrical contact claimed in claim 43 wherein the intersection of said contact surface portion and said flat end surface defines a common curved boundary extending along substantially the entire transverse extent of said contact finger extremity displaced from said strip member first surface.

53. An electrical contact comprising an electrically conductive strip member and plural electrically conductive contact fingers formed integrally with said strip member and commonly supported by said strip member for flexure upon loading thereof by a further contact element to thereby resiliently engage a surface of said further contact element, said contact fingers each having a longitudinal and a transverse extent with respect to said strip member, said contact fingers each defining at the longitudinal extremity thereof an end surface extending along substantially the entire transverse extent of said contact finger, said end surface having first configuration when said contact fingers are not loaded by said further contact element and having second configuration different from said first configuration when said contact fingers are loaded by said further contact element, said contact finger end surface second configuration being complementary to said surface of said further contact element wherein said contact finger end surface second configuration provides area contact between said end surface and said further contact element surface during said loading, said area contact extending substantially the entire transverse extent of said contact finger at said longitudinal extremity thereof.

* * * * *